United States Patent [19]

Liang et al.

[11] Patent Number: 5,008,237

[45] **Date of Patent: * Apr. 16, 1991**

[54] VINYL DEVELOPER RESINS

[75] Inventors: Rong-Chang Liang, Centerville; Karl A. Kintz, Kettering; Joseph G. O'Connor; Paul C. Adair, both of Springboro, all of Ohio

[73] Assignee: The Mead Corporation, Dayton, Ohio

[ * ] Notice: The portion of the term of this patent subsequent to Oct. 31, 2006 has been disclaimed.

[21] Appl. No.: 323,571

[22] Filed: Mar. 14, 1989

Related U.S. Application Data

[63] Continuation of Ser. No. 86,059, Aug. 14, 1987.

[51] Int. Cl.[5] ..... B41M 5/22; G03C 1/68

[52] U.S. Cl. ..... 503/212; 427/150; 430/138; 503/216; 503/225

[58] Field of Search ..... 427/150–152; 428/914; 430/138, 199, 449; 503/212, 216, 217, 225, 226

[56] References Cited

U.S. PATENT DOCUMENTS 4,349,600 9/1982 Miyakawa ..... 428/511

*Primary Examiner*—Bruce H. Hess

*Attorney, Agent, or Firm*—Thompson, Hine and Flory

[57] ABSTRACT

A developer sheet comprising a support having a layer of a color developer on the surface thereof, said color developer being capable of reacting with a substantially colorless electron donating color former to produce a color image and being an acrylic or methacrylic polymer having pendant developer moieties (e.g., hydroxy aromatic or aromatic acid moieties such as salicylic or phthalic acid moieties) which are preferably metallated (e.g., zincated) or being the polymeric reaction product of vinyl salicylic acid or salt.

23 Claims, No Drawings

VINYL DEVELOPER RESINS

This is a continuation of application Ser. No. 086,059 filed Aug. 14, 1987.

BACKGROUND OF THE INVENTION

The present invention relates to a developer resin which is useful in providing visible images through reaction with a color precursor and which is useful in providing transparencies or in providing reproductions having a glossy finish. It more particularly relates to a developer sheet which is capable of providing a controlled degree of gloss ranging from matte to high gloss.

The developer sheet of the present invention can be used in conjunction with conventional pressure-sensitive or carbonless copy paper, or photosensitive and thermal imaging systems in which visible images are formed by image-wise transferring a color precursor to the developer sheet.

Pressure-sensitive copy paper is well known in the art. It is described in U.S. Pat. Nos. 2,550,446; 2,712,507; 2,703,456; 3,016,308; 3,170,809; 3,455,721; 3,466,184; 3,672,935; 3,955,025; and 3,981,523.

Photosensitive imaging systems employing microencapsulated radiation sensitive compositions are the subject of commonly assigned U.S. Pat. Nos. 4,399,209 and 4,416,966 to The Mead Corporation as well as copending U.S. Pat. Application Ser. No. 320,643 filed Jan. 18, 1982. These imaging systems are characterized in that an imaging sheet, which includes a layer of microcapsules containing a photosensitive composition in the internal phase, is image-wise exposed to actinic radiation. In the most typical embodiments, the photosensitive composition is a photopolymerizable composition including a polyethylenically unsaturated compound and a photoinitiator and is encapsulated with a color precursor. Exposure image-wise hardens the internal phase of the microcapsules. Following exposure, the imaging sheet is subjected to a uniform rupturing force by passing the sheet through the nip between a pair of pressure rollers in contact with a developer sheet whereupon the color precursor is image-wise transferred to the developer sheet where it reacts to form the image.

In applications in which the aforementioned pressure-sensitive and photosensitive imaging systems are used to reproduce graphic or picture images, a high degree of gloss is often desired in the reproduction. Where a transparency is desired, the reproduction must transmit light efficiently. These objectives are difficult to achieve using conventional developers. Commonly assigned U.S. Application Ser. No. 905,727 filed Sept. 9, 1986 discloses glossable developers prepared from phenolic resins.

SUMMARY OF THE INVENTION

With the introduction of imaging systems described in U.S. Pat. No. 4,399,209. A need has arisen to produce photographic quality reproductions by transfer of a color precursor to a developer sheet. The reproduction must possess a desired degree of gloss and, in addition, it must not easily crack or abrade when handled analogous to a conventional photograph.

A principal object of the present invention is to provide a novel developer resin which is useful in providing photographic quality images.

A more particular object of the present invention is to provide a developer resin useful in forming high gloss images and which does not yellow.

Another object of the present invention is to provide a developer resin in the form of finely divided thermoplastic microparticles which are capable of coalescing into a thin transparent uniform film upon heating to their film forming temperature.

Still another object of the present invention is to provide a developer resin composition which can be tailored to provide gloss upon coalescence without tack and which resists cracking.

A further object of the present invention is to provide a developer having high abrasion and flexural resistance and a low coefficient of friction.

The developer resins of the present invention are acrylic, methacrylic, or vinyl polymers having pendant developer moieties such as pendant hydroxyaromatic or aromatic acid moieties which are preferably metallated. For example, they are the polymeric reaction product of monomers such as (meth)acryloyloxy benzoates, vinyl salicylic acid, or vinyl salicylic acid salts. It has been found that these resins can be easily modified through copolymerization to provide a combination of gloss, high image density, and good flexural and abrasion resistance. Thus, these resins provide a combination of good reactivity as a developer, good handling and good photographic properties.

The preferred developer resins of the present invention are polymers or copolymers having a repeating unit for the formula (I), (II), or (III) in their structure:

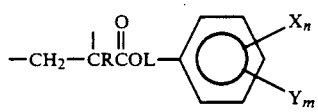

(I)

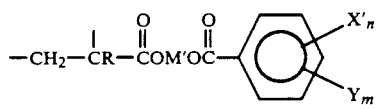

(II)

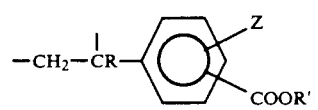

(III)

where

R is a hydrogen atom or a methyl group;

L is a direct bond or a spacer group;

X is —OH, —COOH, —OM, COOR' or a group of the formula (IV):

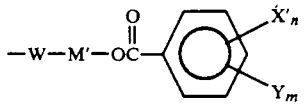

(IV)

Y is an alkyl group, an aryl group, or an aralkyl group;

X' is —OH, —COOH, —OM, or —COOR';

W is —O— or

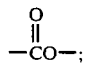

Z is —OH or a hydrogen atom;

M is a metal atom;

M' is a divalent metal atom;

R' is a hydrogen atom, an alkyl group, or a metal atom as defined for M;

n is 1 or 2 and when n is 2, X or X' may be the same or different;

m is 0, 1, or 2 and when m is 2; Y may be the same or different.

DEFINITIONS

The term "developer moiety" as used herein refers to the substituted aromatic ring in formulae (I)-(III)

The term "(meth)acrylic" means methacrylic or acrylic in the alternative.

The developer resins of the present invention may be homopolymers or copolymers. These resins may consist of units of the formulae (I)-(III) above or they can be copolymers of units of the formulae (I)-(III) and units derived from other coplymerizable monomers as discussed below in more detail.

Preferred developer resins are copolymers derived from one or more monomers of the following formulae:

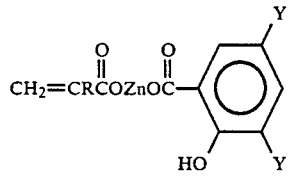

(V)

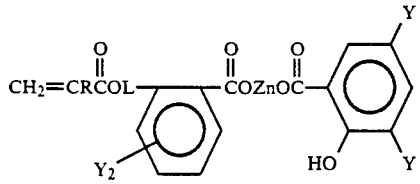

(VI)

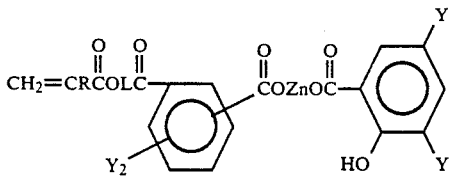

(VII)

where R, Y, L and M are defined as above. The aforementioned monomers can be reacted as starting materials or they can be formed in situ by ligand exchange between an acidic monomer (e.g., acrylic or methacrylic acid and a zinc salt (e.g., zinc salicylate, zinc 3,5 di-t-butyl salicylate, and the like) during polymerization of the acidic monomer.

The preferred developer resins are thermoplastic copolymers obtained as microparticles by emulsion polymerization. The microparticles may range from about 0.01 to 20 microns in diameter and have a melt flow temperature less than about 125° C. and a minimum film forming temperature (MFFT) (ASTM D5354) greater than about 60° C. When the developer resins of the invention are homopolymers they tend to be quite rigid, but they may be ground and mixed with a binder for use on the developer sheet.

Emulsion polymerization is used herein to design developers having unique combinations of properties. In particular, in making coalescable thermoplastic microparticles it is desirable to form particles having a low melt flow temperature and a high MFFT. A high MFFT prevents the particles from fusing together during dryng. A low melt flow temperature enables the particles to readily coalesce for glossing. These two properties conflict with one another and, as a result, the combination previously has been difficult to achieve. However, by forming the developer particles through a multi-stage emulsion polymerization process it is possible to form particles having a relatively soft but resilient core and a relatively hard, tack free, thermoplastic shell with the desired coalescing characteristics. It is also possible to form particles in which developer moieties are preferentially concentrated at the surface of the particle.

Accordingly, one manifestation of the present invention is a developer sheet having a coating of developer resin on the surface which may be a homopolymer but is preferably a copolymer of the repeating unit of the formula (I), (II), or (III) above.

In accordance with the preferred embodiments of the invention, the developer resins are copolymers formed from certain copolymerizable monomers which enhance density, stability to ultraviolet radiation, abrasion resistance, or which provide desirable film forming characteristics. In accordance with the still more preferred embodiments of the invention, the resins are copolymers which include the repeating unit of formula (I) or (II).

Another manifestation of the present invention is a developer sheet in which the aforementioned developer resin is present on the surface thereof as coalescable microparticles.

Still another manifestation of the present invention is an improved process for forming images by reacting a chromogenic material with a developer resin wherein the developer resin is a polymer of a repeating unit of the formula (I), (II) or (III) or a microparticle thereof.

DETAiLED DESCRIPTION

With reference to Formula (I), (II) and (III), X, Y, and M can be any of the substituents or metal ions found in phenolic, hydroxybenzoic acid or benzoic acid type developers. Representative examples of these developers are described in U.S. Pat. No. 3,864,146 to Oda; 3,924,027 to Saito et al.; 3,983,292 to Saito et al. and U.S. Pat. No. 4,219,219 to Sato.

X is typically selected from the group consisting of —OH, —COOH, —OM and —COOM where M is a metal atom selected from the group consisting of zinc, magnesium, calcium, copper, vanadium, cadmium, aluminum, indium, tin, chromium, titanium, cobalt, manganese, iron, and nickel. M is preferably zinc. X is preferably located ortho and/or para in formula (I) meta or para in formula. When the metal atom defined for M has a valency greater than 1, it is chelated with more than one developer moiety. In this case, the developer resin is crosslinked through the metal atom. For example, when X is COOZn in formula (I), the repeating unit can be represented by the formula (Ia):

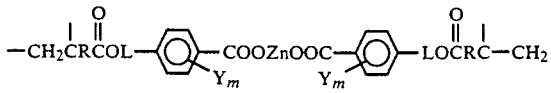

where R, L, Y and m, are defined as above.

In accordance with another embodiment of the present invention X is represented by the formula (IV)

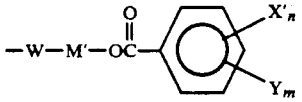

(IV)

where W, M', X' Y', m and n are defined as above.

Y is typically an alkyl, an aryl or an aralkyl group such as a methyl, n-butyl, t-butyl, t-amyl, cyclohexyl, benzyl, α-methylbenzyl, α, α-dimethylbenzyl, diphenylmethyl, diphenylethyl, chlorophenyl, etc. Y is most preferably an alkyl group containing 4 or more carbon atoms or a group containing a monocyclic or bicyclic carbon ring of 6 to 10 carbon atoms. Y is preferably located in positions corresponding to the 3 and 5 positions is salicylic acid.

The spacer group, L in formula (I) and (II), has two functions when it is not a direct bond, namely to stabilize the resin to hydrolysis and to improve developer activity by reducing steric hindrance. By inserting the spacer group L between the aromatic moiety and the carboxyl group the resulting monomer is more resistant to hydrolysis and thermal degradation.

The other function of the spacer group is simply to displace the developer moiety from the polymer chain and reduce the glass transition temperature (Tg) of the polymer. If the developer moiety is coupled directly to the polymer chain, steric hindrance and rigidity of the chains may reduce the activity of the polymer as a developer and reduce film-forming ability.

Those skilled in the art will appreciate that a number of divalent atomic groups can be used as the spacer group L. The exact definition of the spacer group will vary with the nature of the reactants forming the developer moiety. For example, where the developer moiety is derived from a salicyclic acid, the spacer will include the phenolic oxygen atom from the acid. Where it is derived from phthalic acid, the spacer group will include one of the carboxyl groups from the acid. Representative examples of spacer groups are —$CH_2CH_2O$—, —$CH_2CH(OH)CH_2$,O—$CH_2CH(CH_2OH)$—O—, and —$(CH_2)n'$—OCO— where n' is an integer of 1 or more and preferably 2 to 6. These spacer groups result from hydroxyalkyl esters or glycidyl esters of acrylic or methacrylic acids with the developer compound, e.g., the aromatic acid or phenol. Other spacer groups are alkylene bridges having 3 or more carbon atoms and alkylene oxide bridges having 2 or more carbon atoms and one or more oxygen atoms.

As a general rule, the developer resins may contain 1 to 100 wt% of the unit of formulae (I)-(III). The developer resins preferably contain about 10 to 60 wt.% of the unit of formulae (I)-(III) and still more preferably 35 to 55 wt %. If the developer resin of the present invention consists of or contains a high amount of the moiety of formulae (I)-(III), it is very rigid and usually must be ground and dispersed in a binder for application herein.

The repeating unit of the formula (I) is typically derived from a monomer which is prepared by reacting acrylic or methacrylic acid, acryloyl or methacryloyl acid chloride, or acrylic or methacrylic acid esters such as hydroxyalkyl esters or glycidyl esters with a metallated phenol or an aromatic or hydroxyaromatic acid which may be metallated. One monomer useful in preparing developer resins in accordance with the present invention can be prepared by reacting phthalic anhydride with hydroxyethyl acrylate in tetrahydrofuran (THF) to yield methacryloyloxyethyl monophthalate. Another can be prepared by reacting a zinc 3,5-disubstituted disalicylate with glycidyl methacrylate or methacryloyl chloride in THF in the presence of a base (e.g., triethylamine in the case of methacryloyl chloride) or a Lewis acid (e.g. $ZnCl_2$) in the case of glycidyl methacrylate to yield zinc o-methacryloyloxy(hydroxypropyl)oxybenzoate or zinc o-methacryloyloxy benzoate which is filtered, the THF removed, redissolved in ethyl ether and washed with 2% $NaHCO_3$, 0.5% HCl and saturated NaCl. Where X is represented by the formula (IV) above, the monomer is prepared as above but only one mol of the acid, ester, or acid chloride is reacted per mol of a difunctional metal salt.

Specific examples of monomers useful in providing the repeating unit of formula (I) are

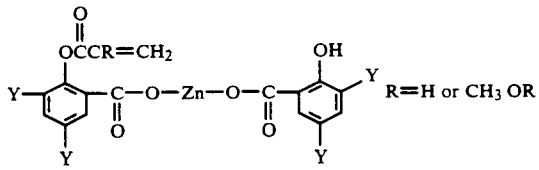

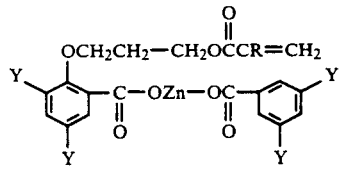

The repeating unit of formula (II) is derived from a mixed metal salt. The monomers yielding (II) can be prepared by reacting acrylic or methacrylic acid with a divalent metal salt of an aromatic acid in a ligand exchange reaction. The molar ratio of the monomer to the salt is such that the monomer displaces one but not both of the basic groups on the salt. This reaction can be conducted in situ as shown in Examples 1 and 2 below. Alternatively, the monomers yielding (II), can be prepared by dropwise adding zinc chloride or zinc sulfate solution to a mixture of sodium (meth)acrylate and sodium salicylate (the sodium (meth)acrylate) solutions should be slightly excess). The mixed salt will precipitate out.

Specific examples of monomers useful in providing unit (II) are

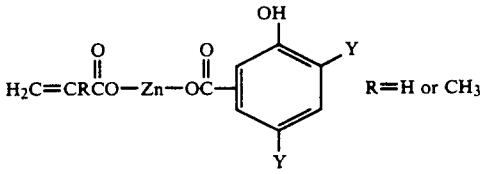

The repeating unit of formula (III) is derived from monomers such as 3-vinylsalicylic acid, 3-vinylbenzoic acid, 4-vinylsalicylic acid, 4-vinylbenzoic acid and 5-vinylsalicylic acid. These compounds may be metallated. They are particularly desirable for incorporating into the developer resin when high resistance to ultraviolet radiation is desired.

Substantially any monomer which is copolymerizable with acrylic or methacrylic acid, acrylates, or methacrylates may be reacted with the aforesaid monomers to produce copolymers useful in the present invention. Copolymerizable monomers that may be used to provide the copolymers of the invention are most typically acrylic or methacrylic acid and vinyl monomers such as styrene, vinylacetate, vinylidene chloride, and acrylic or methacrylic acid esters having 1 to 12 carbon atoms in the ester moiety. The monomer is preferably but not necessarily water insoluble.

Representative examples of acidic co-monomers include acrylic acid, methacrylic acid, maleic acid and itaconic acid. Examples of acrylates and methacrylates include methyl methacrylate, isobutyl methacrylate, n-butyl methacrylate, ethylhexyl acrylate , ethyl acrylate, etc. Diacrylate and triacrylate monomers such as hexane diacrylate, zinc diacrylate and zinc dimethacrylate may be used if crosslinking is desired.

It has been found particularly desirable to copolymerize monomers of the formulae (I) or (II) with a low molecular weight zincated monomer. This is advantageous because it increases the concentration of zinc in the developer resin. Zinc concentrations greater than 4% by weight and preferably greater than 5% by weight are desirable for the developer resin. Useful examples of such zincated monomers are zinc dimethacrylate, zinc diacrylate, zinc itaconate and zinc maleate. These monomers are preferably reacted in an amount of 1 to 20% by weight and preferably 1 to 10% by weight. In selecting these monomers, zinc diacrylate and zinc dimethacrylate are difunctional and crosslink the resin. They can be used to crosslink the microparticle core to give it a degree of elastomeric character. On the other hand, zinc itaconate and zinc maleate are non-crosslinking monofunctional monomers and as such they can be used to increase the effective zinc concentration without crosslinking.

The copolymerizable monomer and the amount in which it is used as well as the nature of the monomers yielding formulae (I)-(III) can be varied to provide the desired developing activity, film forming temperature and degree of tack. It is known in the art that properties such as tack, film forming temperature and glass transition temperature (Tg) can be controlled by polymerizing blends of monomers. For example, a copolymer of a monomer associated with a high Tg and a monomer associated with a low Tg produces a copolymer having an intermediate Tg.

Developer sheets in accordance with the preferred embodiment of the present invention are prepared by coating a suitable support such as paper with an aqueous emulsion or suspension of the developer resin and a binder. In accordance with the invention, the coating of the developer resin must be capable of being dried at an industrially acceptable rate without coalescing the developer. By selecting the appropriate comonomers, in different stages of the core-shell emulsion polymerization, resins can be prepared with specified melt flow temperatures, e.g., 100°to 130° C. (pressure free, 1 minute) and with specified minimum film forming temperatures (MFFT, ASTM D5354) e.g., 60°-80° C. Water based coatings of these resins can be oven dried at temperatures of about 60°-80° C. without coalescence and the developer can still be readily coalesced after reaction with the color former by heating to temperatures of about 100°-130° C. Where coalescence of the developer is not necessary, as in applications in which photographic quality and gloss are not required, the melt flow temperature of the polymer is not critical.

The developer resins of the present invention can be prepared by any known method for polymerizing acryates or vinyl compounds including bulk polymerization and suspension polymerization, however, the preferred method is emulsion polymerization. Emulsion polymerization of acrylates is well known.

One method for tailoring the properties of the developer is to vary the composition of the developer resin between the core and the shell of the microparticle and preferably also at intermediate points in an emulsion polymerization process. This is principally accomplished by varying the nature and the amounts of the monomers reacted, however, the surfactants and initiators can also be varied to produce modifications in the properties of the microparticle. Emulsion polymerization processes have been conducted in from 2 to 6 stages. It is desirable to conduct the polymerization in a large number of stages in order to achieve a gradual transition from the properties of the core polymer to the properties of the shell polymer. In one embodiment, the core is thermoplastic and melts at a lower temperature than the shell. As a result, less total heat is required for film formation. In another, the core is slightly crosslinked and is not melted upon coalescence of the shell, however, if the shell polymer has essentially the same index of refraction as the core or the size of the core is small compared to wavelength of visible light, upon melting the shell, the developer particles become transparent.

It has been found to be particularly desirable to form the microparticle with a relatively soft, resilient core and a relatively hard, higher melting thermoplastic shell. In this manner, a coalescable developer particle can be formed which does not coalesce upon drying but readily coalesces upon heating to the melt flow temperature of the shell. Not only does this assist drying but these microparticles also require substantially less heat to coalesce than a homogeneous microparticle prepared from monomers having a lower Tg and the resulting coalesced film is durable and resists crazing.

Cross-linking the core improves flexural resistance and reduces the tendency for a film of the developer resin to crack. To crosslink the developer resin in the core, it is preferably formed in part from difunctional monomers. Typically about 0.5 to 5 wt% of crosslinking monomer is used in the core. In this regard, in repeating units of the formula (I), when X is COOM or OM, and M is a polyvalent metal atom, the developer resin is crosslinked via the polyvalent metal atom. Difunctional monomers are preferably not used in forming the shell polymer which is preferably thermoplastic.

Additionally, it is also desirable to form the microparticle such that the zinc concentration is higher in the shell than in the core. The principal site for reaction of the developer resin and the color precursor is the shell and hence a high concentration of zincated compounds (about 30 to 50 wt%) is preferred. However, to match refractive indices in the core and shell and improve resin transparency, some zincated compound is generally used in forming the core as seen in the examples. While transparent microparticles are often desired, it will be understood that opaque materials can be produced by mismatching the refractive indices of the core and shell.

The shell and core properties are easily adjusted during the emulsion polymerization process. The microparticle core is formed in the initial stage(s) of the emulsion polymerization process. During this stage or stages it is preferred to use monomers having comparatively low glass transition temperatures, e.g., monomers having a glass transition temperature of —50° to —70° C. are used. This produces a core which is soft and which melts readily during the glossing process. A typical monomer concentration for the polymer core is 87 wt% 2-ethylhexyl acrylate, 3% methacrylic acid and 10% monomer yielding the repeating unit of formulae (I)—(III).

The shell polymer composition should be optimized to provide good developing activity, prevent coalescence upon drying and provide good handling characteristics. In addition to including high concentrations of the developer moiety containing monomer and zinc in the shell, it is also desirable to include higher concentrations (e.g., about 3 to 5 wt%) of acrylic or methacrylic acid. The latter monomers are desirable because they are ionic and stabilize the emulsion and they also catalyze dye development during image formation.

As discussed later, it is also desirable to post-mix a metal (e.g., zinc) salt with the developer to enhance its activity. By providing acrylic or methacrylic acid groups in the core, the zinc salt can chelate with the developer particle and thereby enhance its activity. The shell polymer preferably has a melt flow temperature of about 100°to 125° C. This enables the developer layer to be dried efficiently, limits tack, and allows the developer layer to be coalesced readily at temperatures below 130° C. If the shell polymer has a substantially lower glass transition temperature, the developer microparticles may coalesce prematurely at the time of drying. If the glass transition temperature is too high, excessive time and heat may be required to coalesce the microparticles. A typical shell monomer coposition is 30 wt% monomer yielding the unit of formula (I)-(III) 50 wt% methyl methacrylate and 20 wt.% butyl acrylate.

The foregoing discussion of emulsion polymerization relates to the preparation of coalescable thermoplastic microparticles. Those skilled in the art will appreciate that there are many applications particularly in the field of carbonless or pressure-sensitive recording paper where these properties (particularly coalescence) are not necessary. In these applications, there is more flexibility in the composition of the developer resin since the resin can be ground prior to coating or the resin may be incorporated into a binder or blended with other developers to adjust its properties. Furthermore, other polymerization techniques may be used.

Emulsion polymerization usually also requires the use of an appropriate surfactant and/or protective colloid to stabilize the emulsion and control the size of the microparticles. These materials are commonly referred to as emulsion stabilizers and dispersing agents. Those surfactants or protective colloids which are normally used in the emulsion polymerization of acrylates may be used herein. Representative examples include sodium dodecylbenzene sulfonate, ethylene oxide adducts of alkylphenols. Hydroxyethyl cellulose is particularly desirable for use in preparing a stable emulsion.

Conventional catalysts or initiators for the polymerization of acrylates are useful herein such as benzoyl peroxide, potassium persulfate, t-butyl peroxide, etc. Catalyst concentration may range from about 0.1 to 1% by weight.

Those skilled in the art will appreciate that the developer resins of the present invention can be synthesized by several pathways. For example, in one method, aromatic developer moieties may be added to preformed acrylate or methacrylate homopolymers or copolymers and particularly polymers having acrylic or methacrylic acid or acid chloride derived units. For example, polymers of acrylic or methacrylic acid chloride can be reacted with phenolic or salicylic acid developer compounds. However, this method is relatively expensive. In another method, the developer-moiety containing monomer is prepared and reacted in a free radical polymerization process. A third method is to react a zincated phenol or aromatic acid with acrylic or methacrylic monomers in situ to produce a polymer from which the developer moieties are pendant.

With regard to the latter two methods, phenolics are known inhibitors of free radical polymerization. It has been found, however, that monomers containing a phenolic moiety can be polymerized if the phenol is metallated. The same metal salts which are known to enhance the developing activity of phenols can also be used to prevent inhibition of polymerization. Accordingly, in accordance with the preferred embodiments of the invention, monomers useful in preparing the developer resins of the present invention are prepared from zincated or similarly metallated phenolics. The metallated phenolic must be carefully prepared and purified such that no unchelated phenolic material is present. A particularly useful phenolic purification technique is to dissolve the metallated phenol in chloroform or ether, filter, and wash first with 2% $NaHCO_3$ and then with saturated sodium chloride.

In accordance with another modification of the invention, nonpolymerizable developers can be added directly to an emulsion of the developer resin. These compounds may be compounds which are soluble in the developer resin such as zinc 3,5-di-t-butyl salicylate. If the polymer contains acid, ester or acid chloride groups, the zinc salts may react with the polymer in a ligand exchange reaction.

On the other hand, developer materials which are monomer soluble but not soluble in the developer resin can be added to an emulsion polymerization system prior to polymerization such that the compounds become entrained in the developer resin during the polymerization process. Water soluble materials such as zinc chloride or zinc acetate can be added directly to the emulsion prior to coating. Generally, these materials may be added in an amount ranging from about 0 to 10 parts per 100 parts resin. They increase density, improve abrasion resistance and reduce tackiness.

Where the developer resin is mixed with a binder for coating, useful binders include butadiene copolymers, styrene copolymers, α-methylstyrene copolymers, polyvinyl chloride and vinylidene chloride copolymers, carboxylated styrene-butadiene copolymers, styrene allylalcohol copolymer. The developer resins may be incorporated in the binder in an amount of about 5 to 10,000 parts by weight developer per 100 parts binder.

In the case of developer resin emulsions, a water soluble binder of polyvinyl alcohol, hydroxyethyl cellulose, carboxymethyl cellulose, polyacrylic acid, polyvinyl phenol copolymers, etc. is used. Typical binder/resin ratio is 0.5/100 to 5/100. The developer resin of the present invention may be used alone or in combination with other developer materials including phenolic resins, salicylic acid derivatives or the like.

Useful substrates for the developer sheets of the present invention include paper, synthetic papers, and transparent films such as polyethylene terephthalate film.

Paper weight and film thickness will vary with the particular application.

The resin is preferably applied to the substrate in a dry coat weight of about 5 to 20 g/sq.cm.

The present invention is illustrated in more detail by the following non-limiting examples.

EXAMPLE 1A

The following emulsions were prepared:

| | Parts (wt.) |
|---|---|
| Initial Charge | |
| Butyl Acrylate | 9.0 |
| Methacrylic Acid | 0.3 |
| Zinc 3,5-Di-t-butylsalicylate | 1.0 |
| Dodecylbenzene Sulfonate | 0.485 |
| Ethylene Oxide-Nonylphenol adduct (HLB 17-18) | 0.485 |
| Potassium Persulfate | 0.22 |
| 1-Dodecanethiol | 0.027 |
| Water | 17.5 |
| Sodium acetate | 0.2 |
| Pre-Emulsion I | |
| Butyl Acrylate | 17.6 |
| Methyl Methacrylate | 7.4 |
| Methacrylic Acid | 0.9 |
| Zinc 3,5-Di-t-butylsalicylate | 5.0 |
| Dodecylbenzene Sulfonate | 0.675 |
| Ethylene Oxide-Nonylphenol adduct (HLB 17-18) | 0.675 |
| Potassium Persulfate | 0.05 |
| 1-Dodecanethiol | 0.078 |
| Water | 29.5 |
| Pre-Emulsion II | |
| Butyl Acrylate | 15.5 |
| Methyl Methacrylate | 9.45 |
| Methacrylic Acid | 0.94 |
| Zinc 3,5-Di-t-butylsalicylate | 6.25 |
| Dodecylbenzene Sulfonate | 0.6 |
| Ethylene Oxide-Nonylphenol adduct (HLB 17-18) | 0.6 |
| Potassium Persulfate | 0.05 |
| 1-Dodecanethiol | 0.078 |
| Water | 28.0 |
| Pre-Emulsion III | |
| Butyl Acrylate | 13.1 |
| Methyl Methacrylate | 10.9 |
| Methacrylic Acid | 0.94 |
| Zinc 3,5-Di-t-butylsalicylate | 7.2 |
| Dodecylbenzene Sulfonate | 0.468 |
| Ethylene Oxide-Nonylphenol adduct (HLB 17-18) | 0.468 |
| Potassium Persulfate | 0.05 |
| 1-Dodecanethiol | 0.075 |
| Water | 23.0 |

The Initial Charge was placed in a reactor and stirred while heating to 70° C. The Initial Charge was maintained at 70° C. for 10 minutes and thereafter Pre-Emulsion I was drop-wise added to the reactor over a period of 1.5 hours while maintaining the temperature at 72° C. Similarly, Pre-Emulsion II and Pre-Emulsion III were drop-wise added over periods of 1.5 hours. After the addition of Pre-Emulsion III was completed, 0.018 part of potassium persulfate in 3 parts water was added and the temperature was raised to 76°-80° C. over 1 hour. The emulsion was then allowed to cool to room temperature.

The resulting emulsion had a solids content of about 46%, viscosity of 100-500 cps and a particle size of 0.1 to 0.6 microns.

EXAMPLE 1B

Example 1A was repeated using

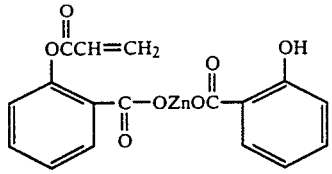

in place of the zinc di-ti-butylsalicylate.

EXAMPLE 1C

Example 1A was repeated using

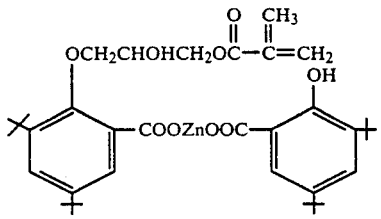

EXAMPLE 2A

Using the same reaction procedure outlined in Example 1A, the following emulsions were prepared and reacted:

| | |
|---|---|
| Initial Charge | |
| Latex from Example 1A | 15.0 |
| Dodecylbenzene Sulfonate | 0.05 |
| Ethylene Oxide-Nonylphenol adduct (HLB 17-18) | 0.05 |
| Potassium Persulfate | 0.12 |
| 2% Hydroxyethyl Cellulose | 3.6 |
| Water | 4.0 |
| Sodium acetate | 0.1 |
| Pre-Emulsion (I) | |
| Butyl Acrylate | 9.6 |
| Methyl Methacrylate | 8.0 |
| Methacrylic Acid | 0.66 |
| 1-Dodecanethiol | 0.055 |
| Zinc 3,5-Di-t-butylsalicylate | 5.28 |
| Dodecylbenzene Sulfonate | 0.343 |
| Ethylene Oxide-Nonylphenol adduct (HLB 17-18) | 0.343 |
| Potassium Persulfate | 0.04 |
| 1% t-butylhydroperoxide | 0.2 |
| Water | 22.0 |
| Pre-Emulsion (II) | |
| Butyl Acrylate | 7.5 |
| Methyl Methacrylate | 8.8 |
| Methacrylic Acid | 0.66 |
| 1-Dodecanethiol | 0.051 |
| Zinc 3,5-Di-t-butylsalicylate | 5.7 |
| Zinc nonylsalicylate | 1.5 |
| Dodecylbenzene Sulfonate | 5.7 |
| Ethylene Oxide-Nonylphenol adduct (HLB 17-18) | 0.32 |
| Potassium Persulfate | 0.04 |
| 1% t-butylhydroperoxide | 0.20 |
| Water | 22.0 |
| Pre-Emulsion III | |
| Butyl Acrylate | 3.6 |
| Methyl Methacrylate | 12.1 |
| Methacrylic Acid | 0.85 |
| 1-Dodecanethiol | 0.047 |
| Zinc 3,5-Di-t-butylsalicylate | 5.9 |
| Zinc nonylsalicylate | 3.0 |
| Dodecylbenzene Sulfonate | 0.276 |
| Ethylene Oxide-Nonylphenol adduct (HLB 17-18) | 0.276 |
| Potassium Persulfate | 0.04 |
| 1% t-butylhydroperoxide | 0.4 |
| Water | 22.0 |

The resulting emulsion had a solids content of 43–48%, a viscosity of 100–500 cps and a particle size of 0.5 to 2.0 micron.

After preparing the emulsion 5 parts per hundred resin of zinc acetate, 1 part hydroxyethyl cellulose, and 0.3 part of the aforementioned ethylene oxide adduct were added to the emulsion to prepare a coating composition which was coated on a paper basestock in an amount of 12g/m$^2$. The paper was mated with an imaging sheet prepared as described in U.S. Pat. No. 4,339,209 and provided a cyan density of 2.0, a magenta density of 2.1 and a yellow density of 1.72. The yellow index of non-image area was 4 after 7 days at 60° C.

EXAMPLE 2B

Example 2A was repeated using the zincated monomer of Example 1B.

EXAMPLE 2C

Example 2B was repeated using the zincated monomer of Example 1C.

Having described the invention in detail and by reference to preferred embodiments thereof, it will be apparent that modifications and variations are possible without departing from the scope of the invention defined in the appended claims.

What is claimed is:

1. A developer sheet comprising a support having a layer of a color developer on the surface thereof, said color developer being a microparticle capable of reacting with a substantially colorless electron donating color former to produce a color image and being a polymer having a repeating unit of formulae (I), (II) or (III)

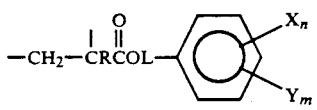

(I)

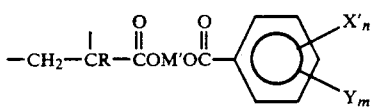

(II)

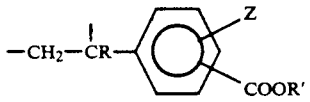

(III)

where R is a hydrogen atom or a methyl group;

L is a direct bond or a spacer group;

X is —OH, —COOH, —OM, COOR' or a group of the formula (IV):

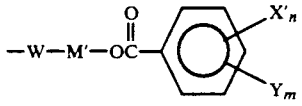

(IV)

Y is an alkyl group, an aryl group, or an aralkyl group;

X' is —OH, —COOH, —OM, or —COOR';

W is —O— or

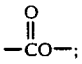

Z is —OH or a hydrogen atom;

M is a metal atom;

M' is a divalent metal atom;

R' is a hydrogen atom, an alkyl group, or a metal atom as defined for M;

n is 1 or 2 and when n is 2, x or X' may be the same or different;

m is 0, 1, or 2 and when m is 2; Y may be the same or different.

2. The developer sheet of claim 1 wherein said developer is a polymer having a repeating unit of formulae (I), (II) or (III)

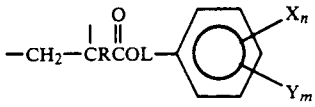

(I)

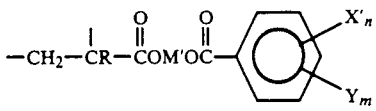

(II)

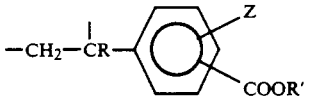

(III)

where

R is a hydrogen atom or a methyl group;

L is a direct bond or a spacer group;

X is —OH, —COOH, —OM, COOR' or a group of the formula (IV):

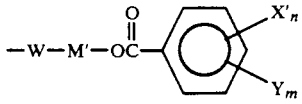

(IV)

Y is an alkyl group, an aryl group, or an aralkyl group;

X' is —OH, —COOH, —OM, or —COOR';

W is —O— or

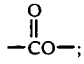

Z is —OH or a hydrogen atom;

M is a metal atom;

M' is a divalent metal atom;

R' is a hydrogen atom, an alkyl group, or a metal atom as defined for M;

n is 1 or 2 and when n is 2, X or X' may be the same or different;

m is 0, 1, or 2 and when m is 2; Y may be the same or different.

3. The developer sheet of claim 2 wherein M is zinc and M' is zinc.

4. The developer sheet of claim 1 wherein said polymer has a melt flow temperature of about 80° C. to 130° C. (pressure free, 1 minute).

5. The developer sheet of claim 4 wherein said polymer contains about 1 to 100 wt% of the repeating unit of formulae (I)-(III).

6. The developer sheet of claim 5 wherein said polymer is a copolymer of a monomer yielding the unit of the formulae (I)-(III) and a monomer selected from the group consisting of acrylic acid, methacrylic acid, alkyl acrylates, alkyl methacrylates, styrene, vinyl acetate, and vinylidene chloride.

7. The developer sheet of claim 6 wherein said copolymer is a copolymer of a monomer selected from the group consisting of zinc diacrylate, zinc dimethacrylate, zinc maleate and zinc itaconate.

8. The developer sheet of claim 7 wherein said copolymer contains at least 4% by weight zinc.

9. The developer sheet of claim 5 wherein said polymer contains about 10 to 60 wt. % of said repeating unit of the formula (I), (II) or (III).

10. The developer sheet of claim 1 wherein said polymer is essentially insoluble in water.

11. The developer sheet of claim 1 wherein said developer is present on said surface as a layer of coalescable microparticles having a particle size of about 0.01 to 20 microns.

12. The developer sheet of claim 11 wherein said polymer is prepared by emulsion or suspension polymerization.

13. The developer sheet of claim 12 wherein said emulsion is stabilized by hydroxyethylcellulose, or polyvinyl alcohol.

14. The developer sheet of claim 11 wherein said microparticles exhibit a minimum film forming temperature greater than 60° C.

15. The developer sheet of claim 1 wherein said polymer is zincated.

16. The developer sheet of claim 1 wherein said polymer is a copolymer containing a repeating unit of said formula (I).

17. The developer sheet of claim 1 wherein said polymer is a copolymer containing a repeating unit of said formula (II).

18. The developer sheet of claim 17 wherein said repeating unit of the formula (II) is the reaction product of a zinc salt of a hydroxyaromatic compound or an aromatic acid with acrylic or methacrylic acid or acid chloride.

19. The developer sheet of claim 1 wherein said polymer is a copolymer containing a repeating unit of said formula (III).

20. The developer sheet of claim 1 wherein said color developer is dispersed in a binder.

21. The developer sheet of claim 1 wherein Y is selected from the group consisting of methyl, n-butyl, t-butyl, t-amyl, cyclohexyl, benzyl, α-methylbenzyl, αα-dimethylbenzyl, diphenylmethyl, diphenylethyl, and chlorophenyl.

22. A pressure-sensitive recording material including the developer sheet of claim 1.

23. A photosensitive recording material employing microcapsules containing a color precursor and a photosensitive composition and including the developer sheet of claim 1.

* * * * *